US008104396B2

(12) United States Patent
Warren

(10) Patent No.: US 8,104,396 B2
(45) Date of Patent: Jan. 31, 2012

(54) REACTIVE ARMOR SYSTEM AND METHOD

(75) Inventor: David H. Warren, Stone Ridge, NY (US)

(73) Assignee: Armordynamics, Inc., Kingston, NY (US)

( * ) Notice: Subject to any disclaimer, the term of this patent is extended or adjusted under 35 U.S.C. 154(b) by 197 days.

(21) Appl. No.: 12/385,126

(22) Filed: Mar. 31, 2009

(65) Prior Publication Data

US 2012/0000352 A1 Jan. 5, 2012

Related U.S. Application Data

(63) Continuation-in-part of application No. 11/979,309, filed on Nov. 1, 2007, now Pat. No. 7,628,104, and a continuation-in-part of application No. 11/978,663, filed on Oct. 30, 2007, which is a continuation-in-part of application No. 11/296,402, filed on Dec. 8, 2005, now Pat. No. 7,383,761.

(60) Provisional application No. 61/064,851, filed on Mar. 31, 2008.

(51) Int. Cl.
*F41H 5/007* (2006.01)

(52) U.S. Cl. ..... 89/36.17; 89/902

(58) Field of Classification Search ..... 89/36.17, 89/902

See application file for complete search history.

(56) References Cited

U.S. PATENT DOCUMENTS

| | | | | |
|---|---|---|---|---|
| 4,081,581 | A * | 3/1978 | Littell, Jr. | 428/138 |
| 6,532,857 | B1 * | 3/2003 | Shih et al. | 89/36.02 |
| 6,962,102 | B1 * | 11/2005 | Johnston et al. | 89/36.17 |
| 7,080,587 | B2 * | 7/2006 | Benyami et al. | 89/36.08 |
| 7,300,893 | B2 * | 11/2007 | Barsoum et al. | 442/134 |
| 7,866,248 | B2 * | 1/2011 | Moore et al. | 89/36.02 |
| 2008/0264243 | A1 * | 10/2008 | Lucuta et al. | 89/36.02 |

* cited by examiner

*Primary Examiner* — Stephen M Johnson
(74) *Attorney, Agent, or Firm* — Andrews Kurth LLP

(57) ABSTRACT

A reactive armor that may include multiple layers. The reactive armor may include a self-healing outer layer, a ceramic tile layer and a backing layer. The ceramic tile layer may include a plurality of ceramic tiles and explosive material. The ceramic tiles may be hexagonal. The ceramic tiles may each define a hollow space in which the explosive material is deposited. The reactive armor may be combined with non-reactive armor.

20 Claims, 10 Drawing Sheets

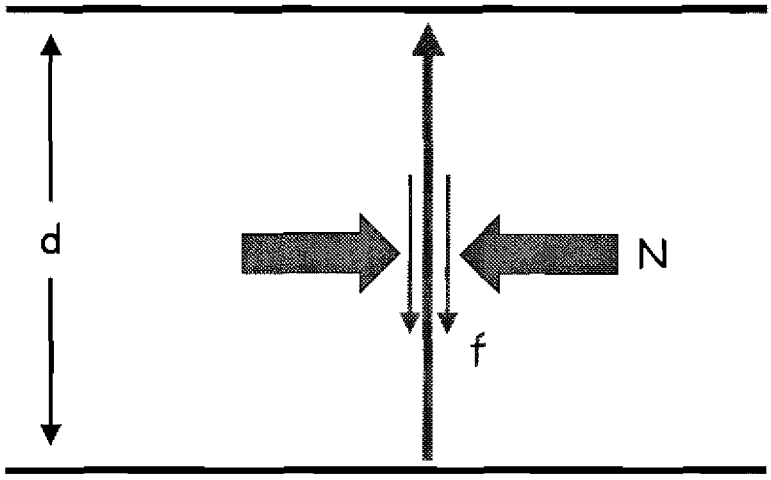
DIAGRAM 1

REACTIVE ARMOR SYSTEM AND METHOD

CROSS-REFERENCE TO RELATED APPLICATIONS

This application claims the priority of U.S. Provisional Application Ser. No. 61/064,851, entitled "Reactive Armor System and Method," ("the '851 application") which was filed Mar. 31, 2008 and is incorporated herein by reference. This application is also a continuation-in-part of U.S. patent application Ser. No. 11/979,309, now U.S. Pat. No. 7,628,104, entitled "Methods and Apparatus for Providing Ballistic Protection," filed Nov. 1, 2007 ("the '104 patent") and U.S. patent application Ser. No. 11/978,663, entitled "Apparatus for Providing Protection From Ballistic Rounds, Projectiles, Fragments and Explosives," filed Oct. 30, 2007 ("the '663 application"), which are a continuation and continuation-in-part, respectively, of U.S. patent application Ser. No. 11/296,402, now U.S. Pat. No. 7,383,761, entitled "Methods and Apparatus for Providing Ballistic Protection," ("the '761 patent"). The above applications and patents are all incorporated herein by reference.

BACKGROUND

Light-weight vehicles are being subjected to a growing and significant problem, Explosively Formed Projectiles (EFPs). Originally reactive armor was designed to defeat anti-tank rounds. These rounds use a conical shape charge capable of producing a high temperature jet delivering a tremendous amount of energy on a single point. EFPs are highly dense solid matter traveling at 7,000 to 8,000 fps with very high kinetic energy making it much harder to stop using a flying plate method.

Stopping a Projectile

The basic concept in stopping a projectile is that work must equal energy. The more work the armor can do on the projectile, the more kinetic energy it can absorb. Conventional armor augments work by increased frictional force through hardness, tensile strength and thickness of the armor system.

Normal force is what gives rise to the friction force, the magnitudes of these forces being related by the coefficient of friction "μ" between the two materials:

$$f=\mu N$$

Therefore, given the mass and velocity of the projectile a simple equation would define the thickness "d" and "f" force to stop the projectile.

The hydrodynamic impact of an EFP delivers an enormous amount of energy. In the past, stopping an EFP has been directly related to the density of the armor. It has always been a balance between weight and thickness. The current solution of using rolled homogeneous armor (RHA) backing with Polyethylene and other composites is not a viable solution for light-weight vehicles. For example, to defeat a 135 mm EFP the required armor would be 12-16 inches thick and 80-120 lbs/psf. Using this logic to stop the current threat the minor system would need to be more then 21 inches thick.

Conventional reactive armor systems are omni-directional thus, the back pressure is rather significant. When designing a proactive armor for light-weight vehicles, the back pressure is a major factor to consider.

SUMMARY

Embodiments of a reactive armor may include reactive armor that includes multiple layers is described herein. The reactive armor may include a self-healing outer layer, a ceramic tile layer and a backing layer. The ceramic tile layer may include a plurality of ceramic tiles and explosive material. The ceramic tiles may be hexagonal. The ceramic tiles may each define a hollow space in which the explosive material is deposited. The reactive armor may be combined with non-reactive armor.

Embodiments of reactive armor that includes multiple layers is described herein. The reactive minor may include a self-healing outer layer, a tile layer and a backing layer that may be affixed to the tile layer. The tile layer may include a plurality of tiles, each defining one or more hollow spaces, and explosive material that at least partially fills hollow spaces in the plurality of tiles. The tiles may be ceramic tiles and may be hexagonal in shape.

DESCRIPTION OF THE DRAWINGS

The detailed description will refer to the following drawings, wherein like numerals refer to like elements, and wherein.

Figure 1B:
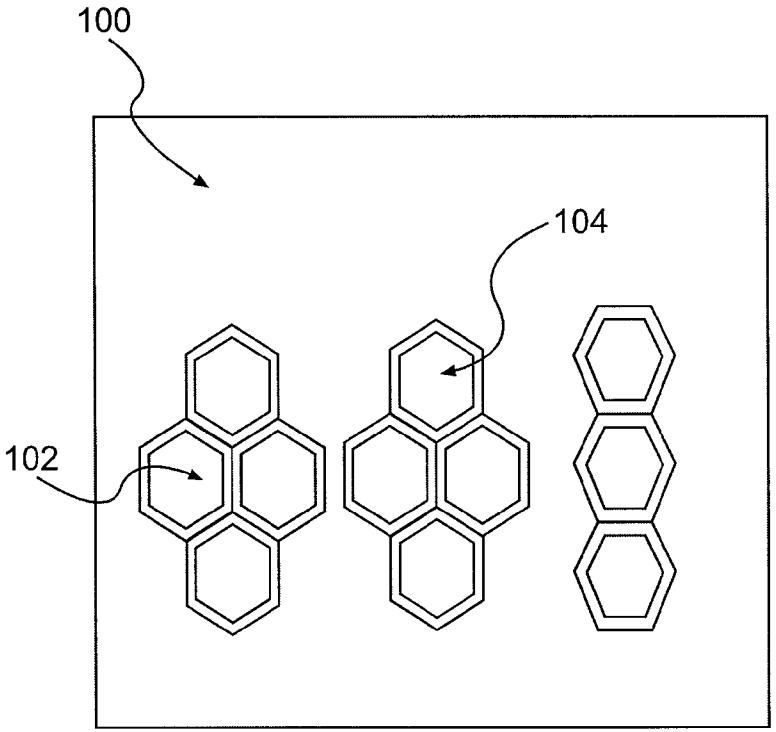
FIGS. 1A-1B are diagrams illustrating embodiments of ceramic tiles and explosive material that may be used in embodiments of reactive armor.

Diagram 1 illustrates a bullet entering a piece of armor.

DETAILED DESCRIPTION

Described herein are embodiments of an armor system and method for defeating armor piercing rounds, EFPs, RPGs and other threats to personnel, vehicles, buildings and property. In bridging the gap between conventional reactive armor systems and the need to minimize back pressure, embodiments provide a focused, directional system that results in little back pressure using a minimal amount of explosive but still provides protection against EFPs. Embodiments provide a new armor system designed for light-weight armored vehicles that is both passive and reactive to defeat armor piercing rounds as well as EFPs. This armor is based on Magmacore™ armor technology that uses a unique 3D matrix for displacing energy as well as several patent pending related applications. See, e.g., the '761 patent and the other cross-referenced applications above.

Embodiments described herein are designed to defeat EFPs by using counter measure shape charges, focusing a tremendous amount of kinetic energy at the point of contact. In various embodiments, armor materials are engineered to be consumed in the reaction of defeating an EFP, thus minimizing secondary fragmentation. Performance Canabilities:

| Conventional Reactive Armor | Reactive Armor Described Herein |
|---|---|
| Ineffective against EFPs | Anti-EFP armor system |
| Produce tremendous backpressure | Minimize backpressure |
| Enormous secondary frags | Reduces secondary frags |
| Heavy | Light |

| Conventional Passive Armor | Reactive Armor Described Herein |
|---|---|
| Thick and bulky | Low profile |
| Heavy | Lightweight |
| Tremendous over pressure | Reduces over pressure |
| Greatly reduce vehicle mobility | Minimal impact on vehicle mobility |

Embodiments described herein provide an armor system that is both passive and reactive and which has the following characteristics:

| | |
|---|---|
| Multi-Threat Capability | Has the ability to take multiple hits from a varying combination of threats (ball rounds, armor piercing and shape charges). |
| Light Weight | Is designed for light weight vehicles. |
| Scalable | May be customized to meet varying threats. |
| Minimize Secondary Fragments | Minimizes collateral damages and reducing secondary fragmentation. |
| Reduce Back Pressure | Proactive counter response minimizes shock trauma effects to vehicle compartments. |
| Low Profile | Low profile minimizes the impact to the vehicle's overall dimensions and reduces the impact on the vehicles functionality. |

Building on the Magmacore™ armor concept of a 3D matrix for displacing energy, the embodiments described herein provide a viable armor to defeat EFPs and other threats. Embodiments described herein have a unique three-dimensional rigid core designed for structural integrity and to displace energy. This design includes a three-prong approach to defeat EFPs; (1) disrupt the EFP, (2) deliver a focused energy "shape charge" and (3) absorb the resulting shock.

Embodiments of the reactive armor described herein provide a passive and reactive armor system, all-in-one, developed specifically for light armored vehicles. Some additional advantages of reactive armor system embodiments are: it is scalable for a range of threats, has flat and curved surfaces, is lightweight, and has a low profile.

Figure 1A:
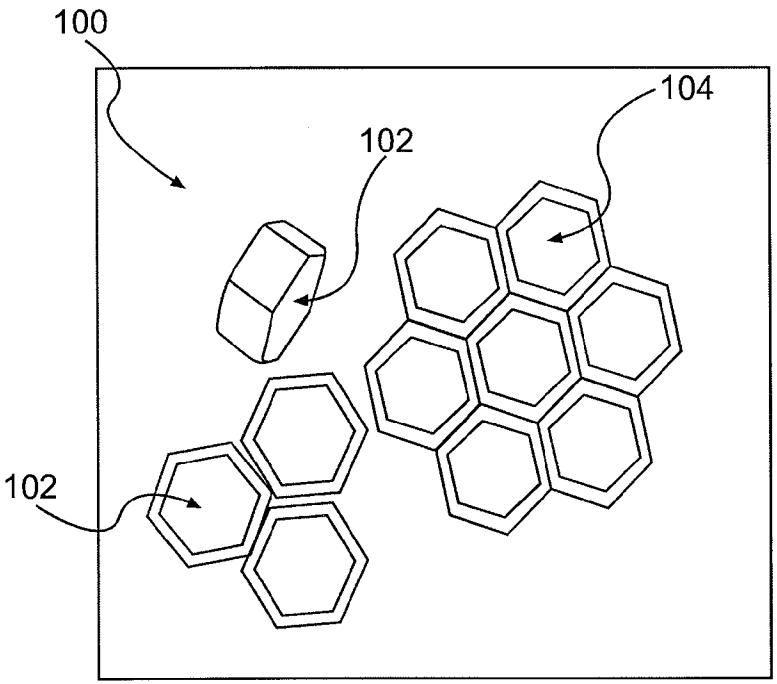

With reference now to FIGS. 1A-1B, embodiments of ceramic tiles 100 used to provide the unique three-dimensional rigid core of embodiments of the reactive armor system are shown. Here, ceramic tiles 100 are hexagonal-shaped and may be placed together as shown. The embodiments shown illustrate different geometric arrangements of ceramic tiles 100, such as linear groupings or wider groupings. In other embodiments, the ceramic tiles may be square or other geometric shape. Each tile shown may have a partially hollowed out section or space 102 in which other material may be placed. In embodiments, the hollowed out space 102 may extend all the way through the center of ceramic tiles 100 or part-way through. If part-way through, the hollowed out space 102 may be on one side or both sides of ceramic tile 100. In embodiments, the space 102 may be filled with a plastic explosive or other explosive material 104. The plastic explosive or other explosive material 104 may provide the reactive component of the reactive armor.

In the embodiment shown, the explosive material 104 is pentaerythritol tetranitrate (PETN). In the embodiment shown in FIG. 1A, ceramic tiles 100 may be filled with 1 gram of PETN explosive material 104 per ceramic tile 100. In the embodiment shown in FIG. 1B, ceramic tiles 100 may be filled with 2 grams of PETN explosive material 104 per ceramic tile 100. The different amounts of explosive material 104 may be determined by the volume of the hollowed out space 102 in ceramic tiles 100. In the embodiment shown in FIG. 1A, for example, the hollowed out space 102 may be large enough to permit up to a 1 gram of explosive material 104. In the embodiment shown in FIG. 1B, for example, the hollowed out space 102 may be large enough to permit up to 2 grams of explosive material 104.

It is also important to note that ceramic tiles 100 may be sized larger or smaller depending on the nature of the expected threats. If more explosive material 104 and larger ceramic tiles 100 are needed to provide effective static armor functionality, larger ceramic tiles 100 may be used.

In the reactive armor, the explosive material 104 reacts to an EFP, or other threat such as an RPG, to deliver focused energy (a shape charge), disrupting the EFP affects. Ceramic tiles 100 may be made of virtually any three-dimensional shape, such as cubes, cylinders, spheres, etc. The tiles may be made out of various materials, other than ceramics, and filled with other materials, such as sand.

With reference now to FIGS. 2A-2D, shown are various embodiments of hexagonal ceramic tiles 200. Each embodiment has a hollow space or spaces 202 in which PETN or other explosive material may be placed. In some of the embodiments shown, the hollow space 202 is on the top and bottom of ceramic tile 200. In other embodiments, the hollow space 202 extends part way through ceramic tile 200 on one side. If ceramic tiles 200 include multiple hollow spaces 202, each hollow space 202 may be of different size and shape.

Figure 2A:
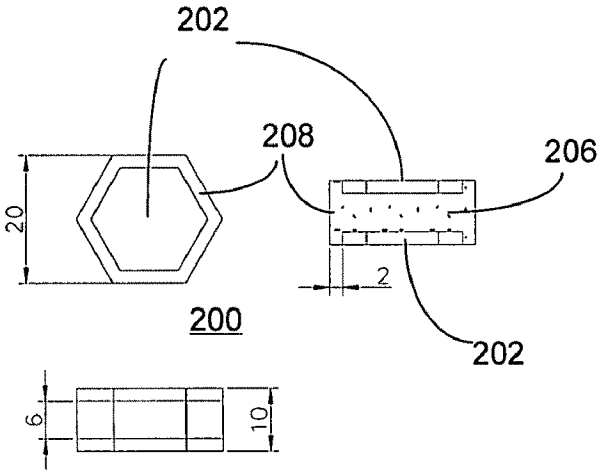
FIGS. 2A-2D are diagrams illustrating embodiments of ceramic tiles that may be used in embodiments of reactive armor.

In FIG. 2A, ceramic tile 200 includes two hollow spaces 202 in the center of ceramic tile 200. The hollow spaces 202 extend partially towards the middle of ceramic tile 200. The depth of the hollow spaces 202 may be varied to accommodate more or less explosive material. In the embodiment show, ceramic tile 200 may have a height of 10 units (e.g., 10 millimeters) and a width of 20 units, providing a relatively short and wide ceramic tile 200. The depth of each hollow space 202 is 2 units, leaving a center, non-hollowed out section 206 of 6 units. The hollow spaces 202 may also leave a tile wall 208 of 2 units thick surrounding the hollow spaces 202. The shape, size, position and other characteristics of the hollow spaces 202 and ceramic tile 200 help to shape the explosive charge produced by the explosive material deposited into the hollow spaces 202.

Figure 2B:
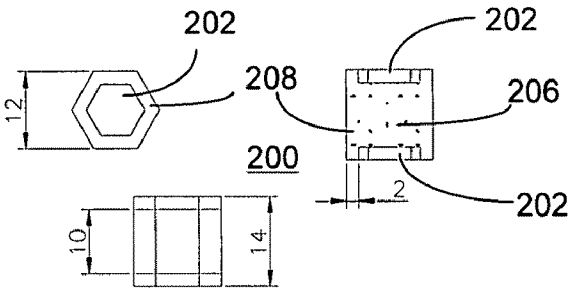

Ceramic tile 200 shown in FIG. 2B may have a height of 14 units (e.g., 14 millimeters) and a width of 12 units, providing a relatively tall and narrow ceramic tile 200. The depth of each hollow space 202 is also 2 units, leaving a center, non-hollowed out section 206 of 10 units. The hollow spaces 202 may also leave a tile wall 208 of 2 units thick surrounding the hollow spaces 202. The shape, size, position and other characteristics of the hollow spaces 202 and ceramic tile 200 help to shape the explosive charge produced by the explosive material deposited into the hollow spaces 202.

Figure 2C:
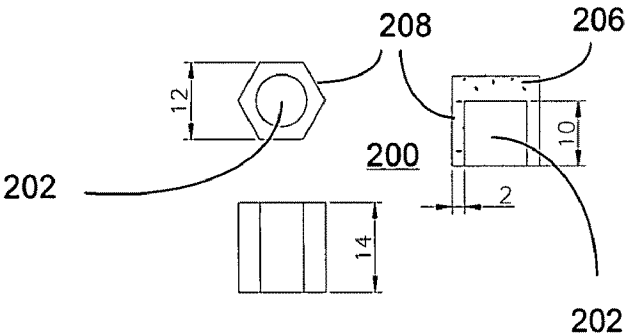
Figure 2D:
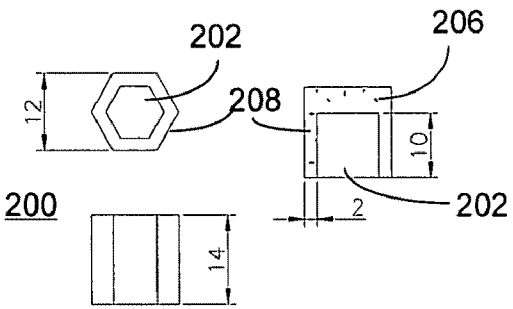

Ceramic tile 200 shown in FIG. 2C may have a height of 14 units (e.g., 14 millimeters) and a width of 12 units, providing a relatively tall and narrow ceramic tile 200. Ceramic tile 200 shown in FIG. 2C, however, only has one hollow space 202. The hollow space 202 shown may have depth of 10 units, leaving a non-hollowed out section 206 of 4 units on one end (e.g., the top) of ceramic tile 200. The hollow spaces 202 may also leave a tile wall 208 of 2 units thick surrounding the hollow space 202. In the embodiment shown here, the hollow space 202 may be circular in shape, as opposed to the hexagonal shape shown in FIGS. 2A-2B. This illustrates that a variety of hollow space shapes may be used which are not limited by the shape of ceramic tile 200. The shape, size, position and other characteristics of the hollow space 202 and ceramic tile 200 help to shape the explosive charge produced by the explosive material deposited into the hollow spaces 202. Ceramic tile 200 shown in FIG. 2D may be nearly identical to ceramic tile 200 shown in FIG. 2C, except that hollow space 202 may be hexagonal in shape. The dimensions, shapes and configurations of ceramic tiles 200, hollow spaces 202, non-hollowed out sections 206 and tile walls 208 may be varied to shape the charge and provide armor characteristics best fitting the application of the ceramic armor.

Figure 3A:
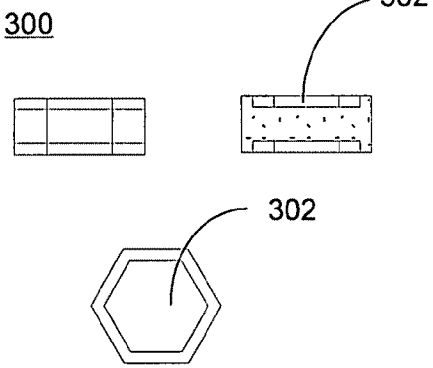
FIGS. 3A-3B are diagrams illustrating an embodiment of ceramic tiles and explosive material, and arrangements of same, that may be used in embodiments of reactive armor.
Figure 3B:
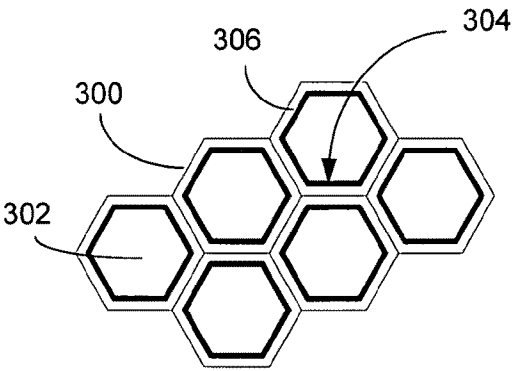
Figure 3C:
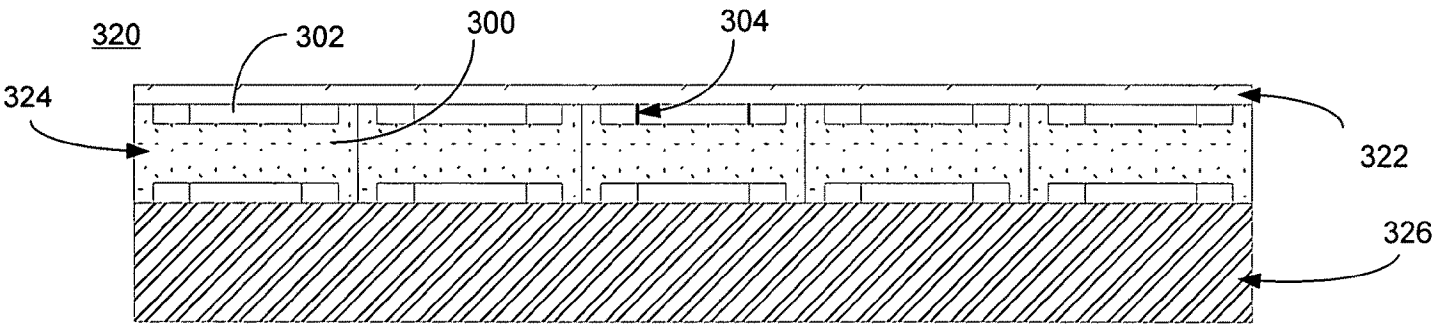
FIG. 3C is a diagram illustrating a cross-section of a portion of an embodiment of reactive armor that may include a layer of ceramic tiles.

With reference now to FIGS. 3A-3C, shown are embodiments of ceramic tiles 300 and arrangements thereof that may be used in an embodiment of reactive armor 320. With reference to FIG. 3A, ceramic tiles 300 may be hexagonal and may have shallow (relative to the thickness of the tiles) hollow spaces 302 on the top and bottom of ceramic tile 300 (e.g., similar to ceramic tile 200 shown in FIG. 2A as described above).

With reference to FIG. 3B, hollow spaces 302 may have explosive material 304 deposited along inner side of walls 306. In the embodiments shown, PETN or other plastic sheet explosive (RDX, HMX, etc.) explosive material 304 may be placed along the inside of walls 306 of the hollow spaces 302. The explosive may be placed in both the top and bottom hollow spaces 302 or in only one of the hollow spaces 302 in ceramic tiles 300. The explosive may not fill the entire hollow space 302. Different ceramic tiles 300 may have different amounts of explosive and explosive may be placed in the top or bottom in different ceramic tiles 302. Basically, the placing of the explosive may be configured for the threat or threats reactive armor 320 is intended to address.

FIG. 3B also shows an example of how ceramic tiles 300 may be arranged next to each other in a ceramic tile layer 324 of reactive armor 320. Ceramic tile layer 324 may include a single ceramic tile-height layer of ceramic tiles 300 arranged as shown in FIG. 3B, or otherwise arranged. Likewise, ceramic tile layer 324 may include multiple ceramic tile-height layers of ceramic tiles 300, stacked on top of one another.

With reference to FIG. 3C, shown is an embodiment of reactive armor 320. A cross-section of a partial portion of reactive armor 320 is shown. Reactive armor 320 may include a self-healing layer 322, e.g., a self-healing polymer skin (e.g., Rhinocast) layer, such as described in the '761 patent or the other cross-referenced patent applications above. When fragments, explosives or other projectiles impact on self-healing layer 322, it "self-heals," closing or partially closing any holes made in self-healing layer 322. Self-healing layer 322 helps to keep ceramic tile 300 fragments within armor 320, maintaining the integrity of ceramic armor 320 and extending its useful life. Self-healing outer layer 322 may encapsulate the ceramic tile layer.

Self-healing layer 322 may be deposited on top of and help contain ceramic tile layer 324. Ceramic tile layer 324, as described above, may include ceramic tiles 300 with explosive 304 deposited along the side walls 306. As described above, ceramic tile layer 324 may include a single layer of ceramic tiles 300 or multiple layers of ceramic tiles 300 stacked on top of one another. Ceramic tiles 300 may be arranged within each layer as shown in FIG. 3B or otherwise. Ceramic tiles 300 may provide stopping, static armor aspects of reactive armor 320 as well as reactive armor aspects described herein. See '761 patent or the other cross-referenced patent applications above.

Reactive armor 320 may also include a backing layer 326. Backing layer 326 may provide backing and additional static armor functionality of reactive armor. Backing layer 326 may also provide protection from reactive armor affects on non-threat side of reactive armor 320. See the '761 patent or the other cross-referenced patent applications for description of backing layers. Backing layer 326 may be made from a variety of materials (e.g., steel, plastic, composite, wood, Magmacore™ armor as described in the '761 patent or the other cross-referenced patent applications) and may be secured to the tiles with an epoxy. Different tiles, such as those shown in FIG. 2, may be used. Additional explosive may also be placed as a sheet on top of the ceramic tile layer 324 or between ceramic tiles 300 in the reactive armor 320.

Figure 4A:
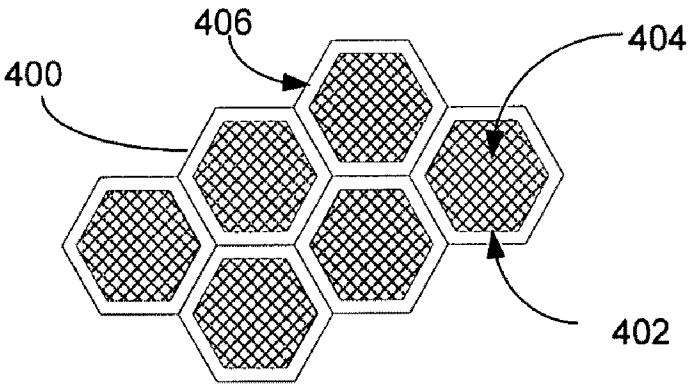
FIG. 4A is a diagram illustrating an embodiment of ceramic tiles and explosive material, and arrangements of same, that may be used in embodiments of reactive armor.
Figure 4B:
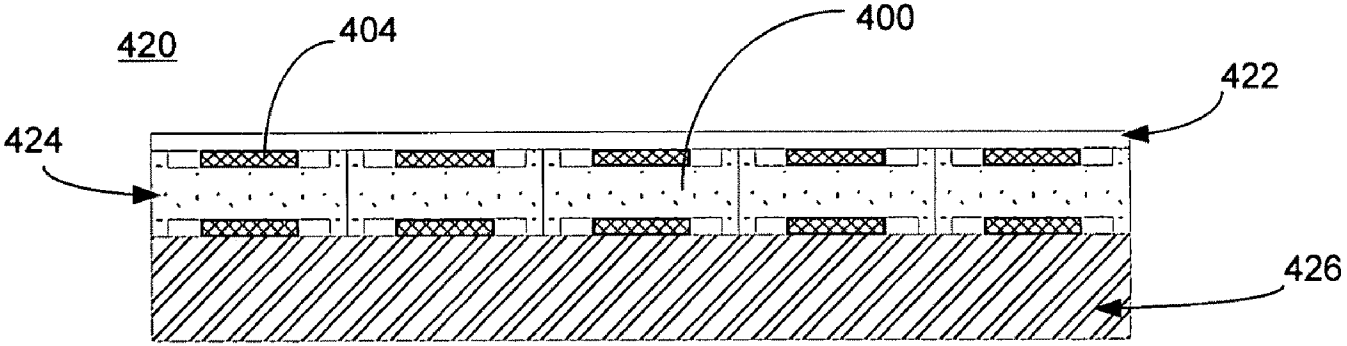
FIG. 4B is a diagram illustrating a cross-section of a portion of an embodiment of reactive armor that may include a layer of ceramic tiles.

With reference now to FIGS. 4A and 4B, shown are embodiments of ceramic tiles 400 and arrangements thereof that may be used in an embodiment of reactive armor 420. In embodiments, the ceramic tiles may have shallow (relative to the thickness of the tiles) hollow spaces 402 on the top and bottom of ceramic tiles 400. The hollow spaces 402 may be filled with explosive material 404, as shown. The explosive material 404 may be PETN, RDX, HMX, other plastic sheet explosive, or other explosive filling the hollow spaces 402. The explosive material 404 may fill both the top and the bottom hollow spaces 402, or either of the hollow spaces 402 in ceramic tile 400. The explosive material 404 may not fill the entire hollow space. Different ceramic tiles 400 may have different amounts of explosive and explosive may be placed in the top or bottom in different ceramic tiles 400. Basically, the placing of the explosive material 404 may be configured for the threat.

With reference to FIG. 4B, shown is an embodiment of reactive armor 420. A cross-section of a partial portion of reactive armor 420 is shown. Reactive armor 420 may include a self-healing layer 422, a ceramic tile layer 424, and a backing layer 426. Each layer may be configured as described above with reference to FIG. 3C. As there, the different layers may be secured to each other with an epoxy, other adhesive or fastener. Different tiles, such as shown in FIG. 2, may be used. Additional explosive may also be placed as a sheet on top of ceramic tile layer 424 or between ceramic tiles 400 in reactive armor 420.

Figure 5A:
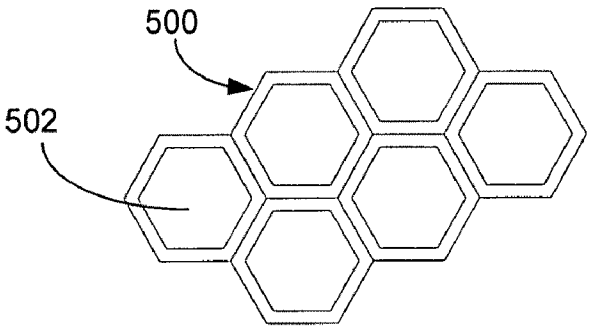
FIG. 5A is a diagram illustrating an embodiment of ceramic tiles and explosive material, and arrangements of same, that may be used in embodiments of reactive armor.
Figure 5B:
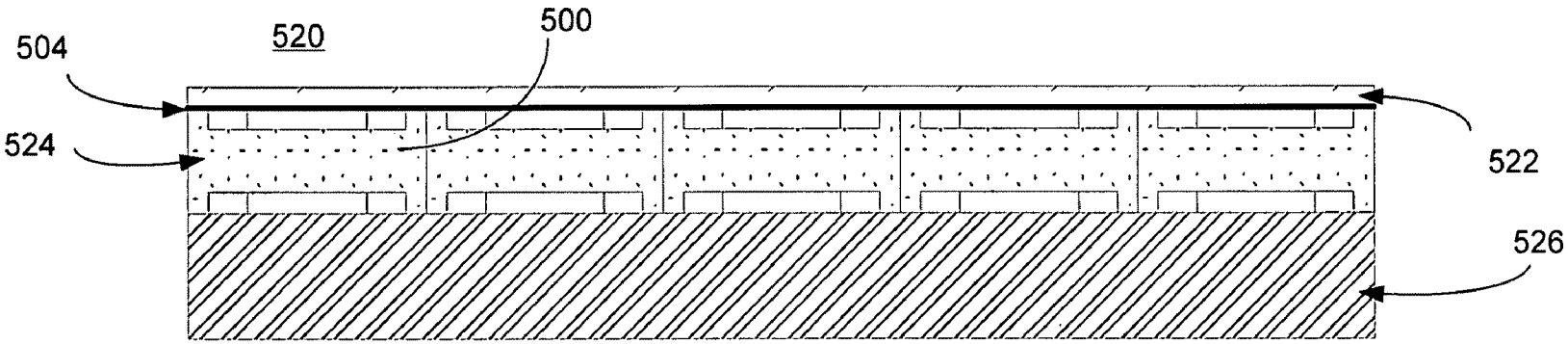
FIG. 5B is a diagram illustrating a cross-section of a portion of an embodiment of reactive armor that may include a layer of ceramic tiles.

With reference now to FIGS. 5A-5B, shown are embodiments of ceramic tiles 500 and arrangements thereof that may be used in an embodiment of reactive armor 520. Ceramic tiles 500 may be hexagonal ceramic tiles that may include hollow spaces 502 on top and bottom of center of ceramic tiles 500. As shown, ceramic tiles 500 may include no explosive material. As shown in FIG. 5B, reactive armor 520 may include a self-healing layer 522, a ceramic tile layer 524, and a backing layer 526. Each layer may be configured as described above with reference to FIG. 3C. As there, the different layers may be secured to each other with an epoxy, other adhesive or fastener. Different tiles, such as shown in FIG. 2, may be used. To provide a reactive armor component, an explosive material layer 504 may be placed as a sheet on top of the ceramic tile layer 524 or between ceramic tiles 500.

Figure 6:
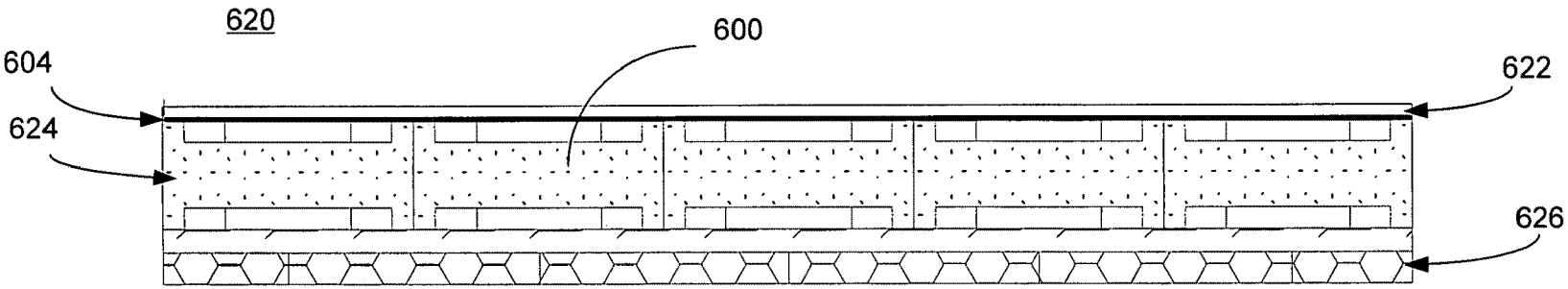
FIG. 6 is a diagram illustrating a cross-section of a portion of an embodiment of reactive armor that may include a layer of ceramic tiles.

With reference now to FIG. 6, shown are embodiments of ceramic tiles 600 and arrangements thereof that may be used in an embodiment of reactive armor 620. Ceramic tiles 600 may be hexagonal ceramic tiles that may include hollow spaces 602 on top and bottom of center of ceramic tiles 600. As shown, ceramic tiles 600 may include no explosive material. Reactive armor 620 may include a self-healing layer 622, a ceramic tile layer 624, and a backing layer 626. Each layer may be configured as described above with reference to FIG. 3C. The self-healing layer 622 may be a polymer skin formed with a layer of wire mesh embedded therein. The wire mesh helps to keep ceramic tile 600 fragments within armor 620, maintaining the integrity of ceramic armor 620 and extending its useful life. The wire mesh may also help to contain explosive fragments. The backing layer 626 may be three-dimensional (3D) safety glass with wire mesh. To provide a reactive armor component, an explosive material 604 may be placed as a sheet on top of ceramic tile layer 624. Alternatively, explosive material 604 may be placed between ceramic tiles 600.

Figure 7A:
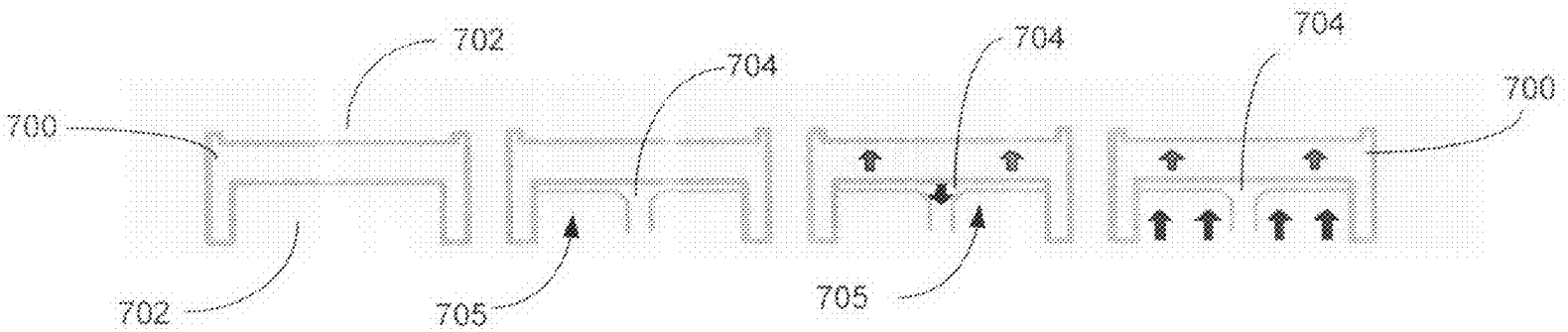
FIGS. 7A and 7B are diagrams illustrating a cross-section of ceramic tiles that may be used in an embodiment of the reactive armor.
Figure 7B:
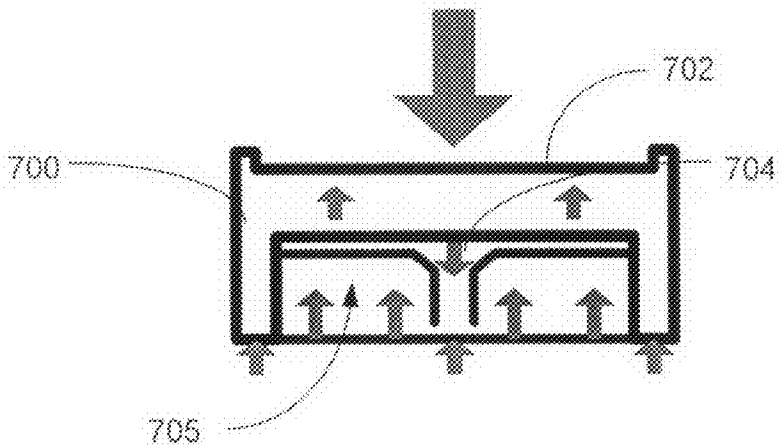

With reference now to FIGS. 7A and 7B, shown are embodiments of ceramic tiles 700 and potential forces resulting from reactive armor utilizing ceramic tiles 700. FIG. 7A illustrates a progressive cross-section view of reactive tile 700, with the potential forces indicated by arrows. Plastic explosive is generally omni-directional. For effective reactive armor, the explosive material 704 should be shaped to have an effective direction. A washer or similar device 705 may be placed into the hollow spaces in the ceramic tiles to shape the explosive. In the three right-most ceramic tiles 700 shown, explosive material in the bottom hollow space 702 of ceramic tile 700 may fill a thin layer above a washer 705, in the hole of the washer 705 (the narrow vertical channel) and below the washer 705. Embodiments of the reactive armor described herein may use a systematized chain reaction to minimize backpressure. The point of impact of the EFP, RPG, fragment, explosive force or other projectile (e.g., in the middle of the tile), triggers the explosion of the explosive material 704 in the vertical channel formed in the washer 705, propagating kinetic force downward, shown by downward arrow. This kinetic force triggers the explosion of the explosive material in the bottom of the hollow space 702, shown by the bottom-most upward arrows, propagating kinetic force upwards, shown by the top upward arrows, against the EFP, RPG, fragment, explosive force or other projectile. This reaction minimizes the affects of the EFP, RPG, fragment, explosive force or other projectile. FIG. 7B illustrates a single ceramic tile 700 and the various forces and reactive forces described above. The large downward arrow represents the downward force of the EFP, RPG, fragment, explosive force or other projectile, the bottom-most upward arrows kinetic force reflecting off of the backing layer as a result of the explosive material in the channel exploding, the middle upward arrows the explosive force of the explosive material in the bottom of the hollow space 702 and the top-most upward arrows the kinetic force resulting from that explosive force.

Figure 8:
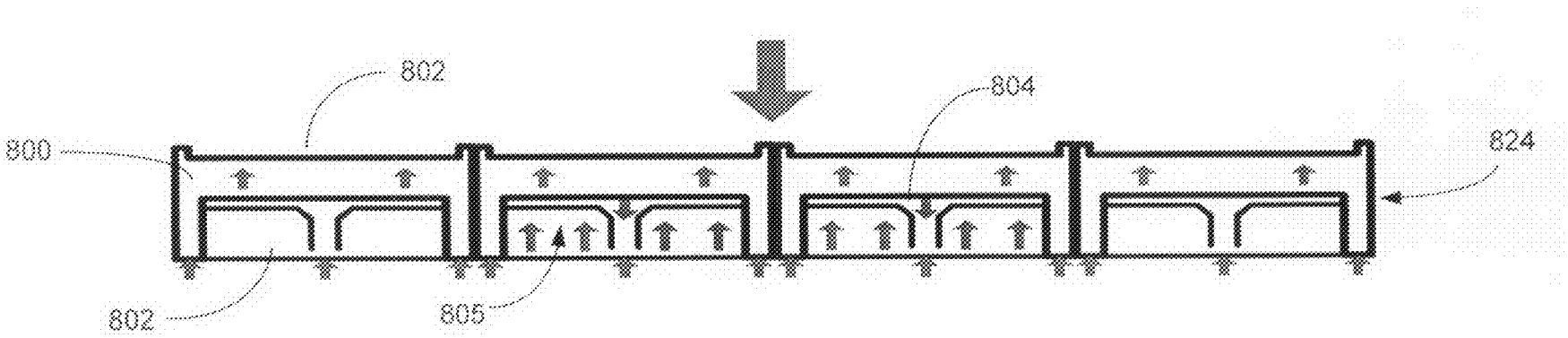
FIG. 8 is a diagram illustrating a cross-section of a layer of ceramic tiles that may be used in an embodiment of reactive armor.

With reference now to FIG. 8, shown is a cross-section of a portion of an embodiment of ceramic tile layer 824 that may be used in reactive armor. This drawing illustrates that the ceramic tiles are designed to contain explosives and explosive force and prevent propagation of the explosives and explosive forces. The explosive force impacts on ceramic tile layer 824 at intersection of two ceramic tiles 800. This triggers resulting reactive armor explosions and resulting opposing kinetic forces, as shown. The explosive material 804 in the two impacted ceramic tiles 800 explodes. However, the ceramic tile walls 806 contain the explosions of the explosive material 804, helping to direct or shape these explosions upwards against the EFP, RPG, fragment, explosive force or other projectile. By helping to shape the explosions of the explosive material 804 upwards, the walls 806 also help prevent the horizontal spread of the explosive affects to adjacent ceramic tiles 800.

Figure 9:
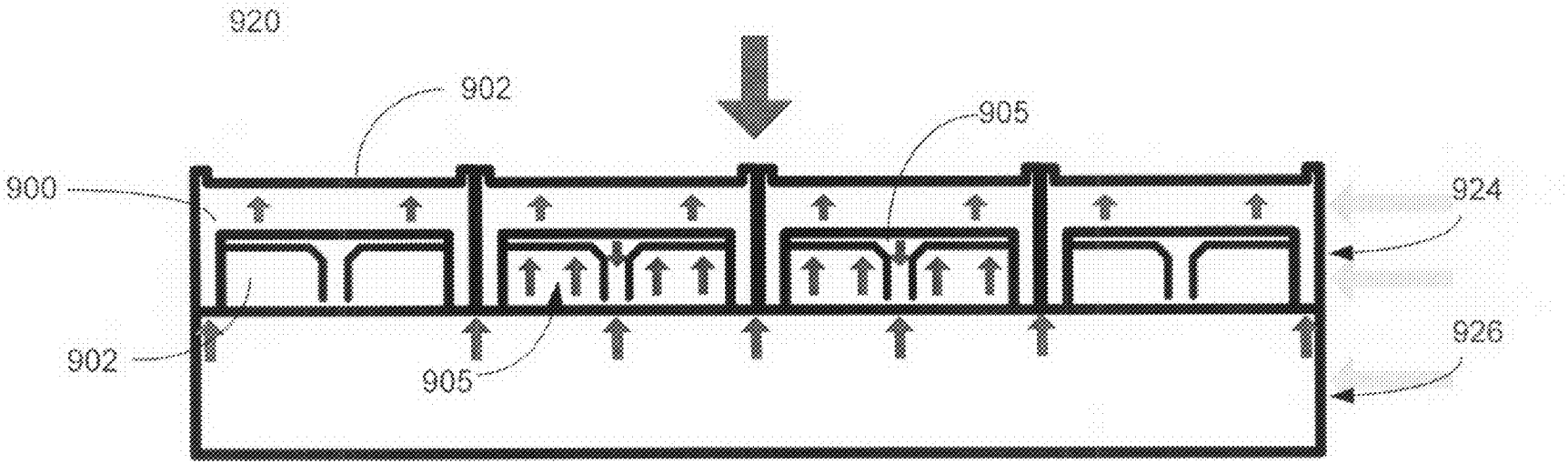
FIG. 9 is a diagram illustrating a cross-section of a portion of an embodiment of reactive armor that may include a layer of ceramic tiles.

With reference now to FIG. 9, shown is a cross-section of a portion of reactive armor 920. As in FIG. 8 above, this drawing illustrates that the ceramic tiles are designed to contain explosives and explosive force and prevent propagation of the explosives and explosive forces. The explosive force impacts on ceramic tile layer 924 at intersection of two ceramic tiles 900. This triggers resulting reactive armor explosions and resulting opposing kinetic forces, as shown. The explosive material 904 in the two impacted ceramic tiles 900 explodes. However, the walls 906 contain the explosions of the explosive material 904, helping to direct or shape these explosions upwards against the EFP, RPG, fragment, explosive force or other projectile. By helping to shape the explosions of the explosive material 904 upwards, the walls 906 also help prevent the horizontal spread of the explosive affects to adjacent ceramic tiles 900.

Reactive armor 920 may include a ceramic tile layer 924 and a backing layer 926. Reactive armor 920 may also include a self-healing layer, which is not shown in FIG. 9. Downward explosive force resulting from EFP, RPG, fragment, explosive force or other projectile and explosive material 904 explosion (e.g., in vertical channel formed by washer 905), generates a reactive upward kinetic force from backing layer 926, as shown. Backing layer 926 may be steel. The steel may represent a vehicle. Reactive armor 920 may be affixed to the exterior of the vehicle. Unlike conventional reactive armor the majority of the material used in the reactive armor 920 described herein is designed to be consumed, minimizing secondary fragmentations.

Summary of Reactive Armor Results

Various testing, as illustrated and described in the '851 application, was performed on embodiments of the reactive armor described herein. During testing, embodiments of the reactive armor were able to greatly reduce the depth and width of the cut from various explosions, such as a 5400 grain Liner Shape Charge (LSC) (used to minimize the possibility of skewing the tests used a 5400 grain linear shape charge known for its' consistency). The unimpeded Liner Shape Charge cut into the RHA the furthest. The 2 mm Dura Sheet Explosive did help reduce the depth and width of the cut, but with great back pressure. Increasing the Dura Sheet Explosive to 6.4 mm did not improve the results from 2 mm of Dura Sheet Explosive, however the back pressure was so great that it deformed the 1¼ steel. In this case the Dura Sheet Explosive actually was helping the LSC.

The best result achieved was using ceramic tiles with 2 grams of Dura Sheet Explosive per ceramic tile. See the table and graph below

| RHA | Dura sheet 2 mm | Dura sheet 6.4 mm | Ceramic Tiles | Dura Sheet 1 gram per ceramic tile | Dura sheet 2 grams per ceramic tile |
|---|---|---|---|---|---|
| 1.14 | 0.823 | 0.81 | 0.55 | 0.48 | 0.45 |
| 0.625 | 0.601 | 1.05 | 0.428 | 0.326 | 0.301 |

In developing the reactive minor, testing was conducted to confirm the structure of the ceramic layer or core provides protection to the explosive and that the reactive armor embodiments is stable in non-EFP conditions. The strain tests performed determined that reactive minor, with ceramic tiles filled with explosive material, would not detonate from the affects of a non-EFP/RPG impact. See the '851 application.

A pinch test was also performed to see if the ceramic tiles filled with explosive material would detonate and the result was no detonation. The ceramic tiles contained the explosive from redundant detonation in this pressure test. See the '851 application.

Additional tests were performed to determine if reactive armor with ceramic tiles filled with explosive material would detonate from the affects of small arms fire. The result was no detonation. Another test was conducted to determine structural performance and the result was that the reactive armor with ceramic tiles filled with explosive material contained the explosion from the redundant detonation with ½ lbs of PETN.

Various embodiments of reactive armor and various combinations of the reactive armor embodiments described herein may be used to address a threat from EFPs, RPGs and threats. For example, multiple layers of reactive armor embodiments described herein may be used. Layers of reactive armor combined with layers of armor described in the '309 application, the '663 application, and/or the '761 patent. Such combinations may be configured, for example, as described in '309 application, the '663 application, and/or the '761 patent. One of the many advantages of the reactive armor, armor described in the '309 application, the '662 application, and/or the '761 patent, is that it may be designed to address virtually any threat.

The terms and descriptions used herein are set forth by way of illustration only and are not meant as limitations. Those skilled in the art will recognize that many variations are possible within the spirit and scope of the invention as defined in the following claims, and their equivalents, in which all terms are to be understood in their broadest possible sense unless otherwise indicated.

The invention claimed is:

1. A reactive armor comprising:

a self-healing outer layer;

a ceramic tile layer that includes a plurality of ceramic tiles that each define at least one hollow space and explosive material, wherein the explosive material is deposited in the at least one hollow space of substantially all of the plurality of ceramic tiles so that substantially all of the plurality of ceramic tiles encapsulate a portion of the explosive material and separate the portion of the explosive material from other portions of the explosive material; and a backing layer.

2. The reactive armor of claim 1 wherein the ceramic tiles are hexagonal.

3. The reactive armor of claim 1 wherein the ceramic tile layer includes multiple layers of ceramic tiles.

4. The reactive armor of claim 1 wherein the ceramic tile layer is affixed to the backing layer with an epoxy.

5. The reactive armor of claim 1 wherein the self-healing outer layer encapsulates the ceramic tile layer.

6. The reactive armor of claim 1 wherein the self-healing outer layer is a polymer.

7. The reactive armor of claim 1 wherein the self-healing outer layer includes wire mesh.

8. The reactive armor of claim 1 wherein the backing layer is steel.

9. The reactive armor of claim 1 wherein the backing layer is safety glass and wire mesh.

10. The reactive armor of claim 1 wherein the ceramic tiles each define a plurality of hollow spaces.

11. The reactive armor of claim 10 wherein the explosive material fills one of the plurality of hollow spaces in each ceramic tile.

12. The reactive armor of claim 10 wherein one of the hollow spaces include a washer.

13. The reactive armor of claim 12 wherein the explosive material fills one of the hollow spaces around and through the washer.

14. A reactive armor system including one or more layers of the reactive armor of claim 1 and one or more layers of non-reactive armor.

15. The reactive armor of claim 1 further comprising one or more additional layers of ceramic tiles.

16. A reactive armor comprising:

a self-healing outer layer;

a ceramic tile layer that includes a plurality of ceramic tiles that each define at least one hollow space and explosive material, wherein the explosive material is deposited in the hollow spaces;

a layer of explosive material on top of the ceramic tile layer; and a backing layer.

17. A reactive armor comprising:

a self-healing outer layer;

a tile layer that includes a plurality of tiles, each defining one or more hollow spaces, and explosive material that at least partially fills the one or more hollow spaces in each of the plurality of tiles, wherein the plurality of tiles each encapsulate a portion of the explosive material and separate the encapsulated portion of the explosive material from other portions of the explosive material; and a backing layer affixed to the tile layer.

18. The reactive armor of claim 17 in which the tiles are ceramic tiles.

19. The reactive armor of claim 17 wherein the tiles are hexagonal.

20. The reactive armor of claim 17 further comprising one or more additional layers of tiles.

* * * * *